US012030113B2

(12) United States Patent
Wachter et al.

(10) Patent No.: US 12,030,113 B2
(45) Date of Patent: Jul. 9, 2024

(54) HOLLOW ARTICLE MADE OF AMORPHOUS METAL

(71) Applicant: Heraeus Amloy Technologies GmbH, Hanau (DE)

(72) Inventors: Hans Jürgen Wachter, Karlstein (DE); Elena Bien, Karlstein (DE)

(73) Assignee: HERAEUS AMLOY TECHNOLOGIES GMBH, Hanau (DE)

( * ) Notice: Subject to any disclaimer, the term of this patent is extended or adjusted under 35 U.S.C. 154(b) by 0 days.

(21) Appl. No.: 17/996,056

(22) PCT Filed: Apr. 6, 2021

(86) PCT No.: PCT/EP2021/058883
§ 371 (c)(1),
(2) Date: Oct. 12, 2022

(87) PCT Pub. No.: WO2021/209280
PCT Pub. Date: Oct. 21, 2021

(65) Prior Publication Data

US 2023/0201913 A1 Jun. 29, 2023

(30) Foreign Application Priority Data

Apr. 17, 2020 (EP) ..... 20170051

(51) Int. Cl.
*B22C 9/10* (2006.01)
*B22C 9/24* (2006.01)
(Continued)

(52) U.S. Cl.
CPC ..... *B22C 9/103* (2013.01); *B22C 9/24* (2013.01); *B22D 15/02* (2013.01);
(Continued)

(58) Field of Classification Search
CPC ..... B22C 9/103; B22C 9/24; B22D 17/2263
See application file for complete search history.

(56) References Cited

U.S. PATENT DOCUMENTS 6,044,893 A 4/2000 Taniguchi et al.

FOREIGN PATENT DOCUMENTS

CN 108372278 A * 8/2018 ..... B22D 11/006
EP 3444370 A1 2/2019
(Continued)

OTHER PUBLICATIONS

Miller et al., Bulk Metallic Glasses—An Overview, Springer-Verlag US, Chapter 1, pp. 2-17, Chapter 8, pp. 210-222 (2008), , Springer.

*Primary Examiner* — Kevin E Yoon
(74) *Attorney, Agent, or Firm* — Panitch Schwarze Belisario & Nadel LLP

(57) ABSTRACT

A method for producing a hollow article made of amorphous metal comprising the steps of: a) providing a metal composition, b) melting the composition according to step a) in order to obtain a melt, c) introducing the melt according to step b) into a cavity of a casting mold, the casting mold comprising an inner core, at least a portion of the lateral surface of the inner core being surrounded by a separation element, d) cooling the melt in the casting mold in order to obtain a molded part made of amorphous metal, e) removing the inner core and the separation element from the molded part according to step d) in order to obtain a hollow article made of amorphous metal. The present invention also relates to a hollow article made of amorphous metal, more particularly to a pipe made of amorphous metal.

12 Claims, 2 Drawing Sheets

(51) Int. Cl.

| | |
|---|---|
| ***B22D 15/02*** | (2006.01) |
| ***B22D 17/22*** | (2006.01) |
| ***C22C 1/11*** | (2023.01) |
| ***C22C 33/00*** | (2006.01) |
| ***C22C 45/00*** | (2023.01) |

(52) U.S. Cl.
CPC ..... *B22D 17/2236* (2013.01); *B22D 17/2263* (2013.01); *C22C 1/11* (2023.01); *C22C 33/003* (2013.01); *C22C 45/001* (2013.01)

(56) References Cited

FOREIGN PATENT DOCUMENTS

| | | | |
|---|---|---|---|
| JP | H07268597 | A | 10/1995 |
| JP | 2008100264 | A | 5/2008 |
| JP | 2010284681 | A | 12/2010 |

* cited by examiner

HOLLOW ARTICLE MADE OF AMORPHOUS METAL

The present invention relates to a method for producing a hollow article made of amorphous metal and to a hollow article made of amorphous metal.

Amorphous metals, also called metallic glasses, can be obtained during the casting process by rapid cooling of a metallic melt. As a result of the rapid cooling of the melt, the metal solidifies without any regular crystalline lattice structures and/or grain and phase boundaries. An amorphous metal is therefore a metallic compound in which the individual atoms are not constrained by a long-range order, but only a short-range order.

In terms of their mechanical, electrical/electromagnetic and chemical properties amorphous metals differ sometimes considerably from regular—in other words crystallized—metals. Amorphous metal generally thus has a greater hardness and strength and also increased elasticity and bendability. In addition, amorphous metals can have a high magnetic permeability and a slight magnetization/demagnetization. In addition, most amorphous metals prove to be particularly corrosion-resistant. Due to their extraordinary properties, amorphous metals are used, for example, in medical technology, in aerospace technology and in sports equipment or are installed in electric motors.

Amorphous metals are frequently produced in the form of thin layers or strips that have a diameter of less than one millimeter. However, it is also possible in principle to produce amorphous metals with diameters of more than one millimeter. Upwards of a certain minimum diameter of the amorphous metal, such as, for example, >1 mm, one also speaks of a metallic solid glass or a bulk metallic glass (BMG).

Methods for producing hollow articles made of amorphous metals or of bulk metallic glass are known in principle in the prior art. In the known methods, such hollow articles are produced by introducing a suitable metallic melt into the hollow space of a casting mold in which an inner core is arranged. As soon as the casting mold is completely filled by the metallic melt, and thus the shaping part of the inner core is in contact with the melt, the melt is rapidly cooled. Conditions are selected such that the melt solidifies to form an amorphous metal.

During cooling, the cast metal can shrink onto the tool components, i.e., the volume of the metal can change by cooling such that tensions and/or solidification can occur between the amorphous metal and the tool components. This is in particular the case when the melting temperature and the temperature of the core differ from one another and/or there are considerable differences in thermal expansion.

After the melt has cooled, the hollow article must be demolded or ejected from the casting mold. For this purpose, it is necessary for the inner core to also be removed from the molded part. Due to the shrinkage of the metal, removal of the inner core can lead to damage to the inner surface of the hollow article in the form of scratches, grooves or fracture. In some cases, removal of the inner core is not possible at all without destroying the hollow article or without removing the inner core mechanically.

In order to avoid damage to the hollow article as much as possible during demolding, inner cores or splits with mold drafts or demolding drafts are used in the prior art. The use of inner cores or splits with mold drafts leads to the inner diameter of the cavity of the hollow article obtained not being constant. If a constant inner diameter of the cavity is desired, the body will need to be reworked accordingly. Such reworking is particularly complicated due to the hardness of the amorphous metal. In addition, the use of oblique inner cores limits the geometric shape or the dimensions of the hollow article. In particular, the length or depth of the cavity is greatly limited. For example, a tube made of amorphous metal can only be manufactured in very short lengths when using an oblique inner core or split. Furthermore, the use of a mold draft cannot always prevent the metal surface from being damaged during demolding.

In addition to the mentioned disadvantages with regard to the design of the cast hollow article, the material of the tool core influences the parameters of the casting process. As a rule, depending on the core material used, certain minimum parameters must be complied with in order to ensure a smooth production of a molded part. For example, the tool must be pre-tempered in a certain way in order to take into account the thermal expansion coefficient of the core material. In the case of a tool core made of steel, a pre-temperature of 200° C. should not be significantly undershot, for example, so as not to make demolding even more difficult after the melt has cooled.

It is desirable to provide a method for producing hollow articles made of amorphous metal that does not have the disadvantages mentioned.

It is desirable to provide a method that allows easier demolding of the hollow article after casting. In addition, it is desirable to provide a method that is not dependent on oblique inner cores, and thus avoids the accompanying constraints in the design of the hollow article. It would be particularly advantageous to be able to produce hollow articles made of amorphous metal, such as, for example, tubes, which have comparatively long or deep cavities and/or have a constant internal diameter. It would also be advantageous if such hollow articles could be obtained without extensive reworking.

Figure 1:
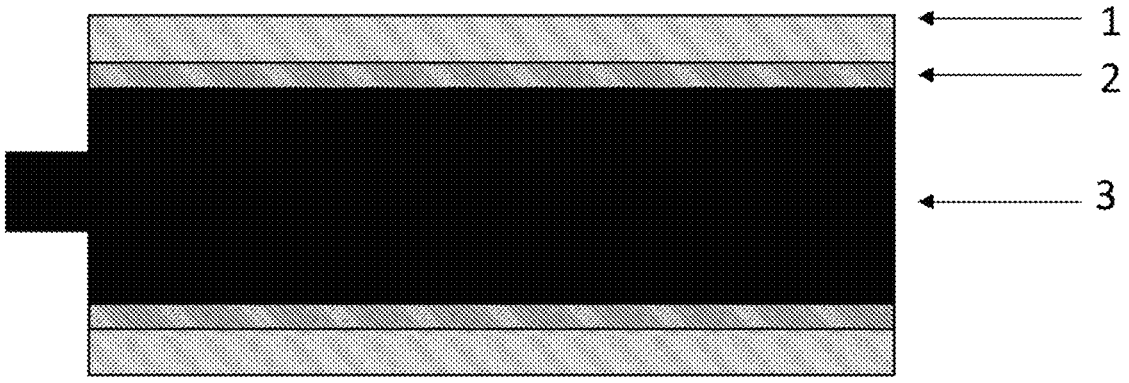
FIG. 1 shows a cross-section of a cylindrical inner core whose entire shaping lateral surface is enclosed by a hollow cylindrical separation element, wherein the separation element is surrounded by a cooled amorphous metal.

The object of the present invention is to provide an improved, at least an alternative, method for producing hollow articles made of amorphous metal. Associated with this, the object is to provide an improved, at least an alternative, hollow article made of amorphous metal.

The object of the present invention has been achieved by the method according to independent Claim 1 and by the hollow article according to independent Claim 13.

One aspect of the present invention relates to a method for producing a hollow article made of amorphous metal. The method comprises the steps of:

a) providing a metallic composition suitable for producing amorphous metal, b) melting the composition according to step a), in order to obtain a melt, c) introducing the melt after step b) into a cavity of a casting mold, wherein the mold comprises an inner core, wherein at least a part of the lateral surface of the inner core is enclosed by a separation element, and wherein the separation element is not attached to the inner core, d) cooling the melt in the casting mold, in order to obtain a molded part made of amorphous metal, e) removing the inner core and the separation element from the molded part after step d), in order to obtain a hollow article made of amorphous metal.

A "hollow article" for the purposes of the present invention is a body that has at least one hollow space, preferably in the form of a hole, a contour hole or a penetration.

An "amorphous metal" for the purposes of this invention is a metal that has an amorphous fraction of more than 90%, preferably of more than 95%, particularly preferably of more than 98%. The crystalline fraction can be determined by DSC as a ratio of maximum crystallization enthalpy (determined by crystallization of a completely amorphous reference sample) and the actual crystallization enthalpy in the sample.

The "cavity" of the casting mold is understood to mean the hollow space of the casting mold that can be filled by the molten metal. The cavity of the casting mold is predetermined by the casting mold, the inner core and the separation element, which encloses at least a part of the lateral surface of the inner core without being attached thereto. The inner core and the separation element provide the shape and dimensions of the hollow space of the hollow article.

"Not attached" in connection with step c) means that the separation element and the inner core are not connected by a fastening element, are not connected in a form-fitting manner and/or no chemical bond is not formed between the separation and the inner core. In a preferred embodiment, the separation element is loosely attached. For example, the separation element at the inner core can have a clearance in the range from 0.05 mm to 1 mm, preferably in the range from 0.1 mm to 0.5 mm (at a temperature of 20° C.). In a preferred embodiment of the invention, no further layers, such as separating layers, are present between the inner core and the separation element Surprisingly, the inventors have found that the unattached mounting of a separation element on a tool core significantly simplifies the demolding of a cast hollow article made of amorphous metal. The arrangement of the separation element on the lateral surface of the inner core results in a reduced or even no tension and/or contact between the amorphous metal and the inner core. Tension and/or contact exists primarily between the amorphous metal and the separation element. During the demolding of the hollow article from the casting mold, the inner core can therefore be pulled out or pressed out of the recess in the hollow article without any special effort. The separation element is left on the inner side or inner wall of the hollow article and can then be removed.

The method according to the invention thus allows a significantly improved demolding of the hollow article from the tool, especially of the hollow space of the hollow article from the inner core. As a result, a hollow article with a high-quality inner surface can be produced. In addition, in the method according to the invention, when designing the tool core or the separation element, the use of a demolding draft can be dispensed with, without this leading to significant damage to the produced hollow article during demolding. Dispensing with demolding drafts on the tool core in turn leads to more degrees of freedom in the design of the hollow article, in particular in the design of the hollow space of the hollow article. For example, a longer tube made of amorphous metal can be cast. A tube that has a constant inner diameter and/or no demolding draft on the inside can be cast. The material surface of the cavity of the hollow article, for example, of the tube, can also be improved, since the interior needs to be machined less or not at all. In this way, the efficiency of the production process can be increased and/or some of the starting material of the amorphous metal can be saved.

In addition, the use of the separation element makes it possible to produce the hollow article made of amorphous metal with a lower preheating of the tool, for example to a tool temperature below 150° C. In the absence of the separation element, with such a weakly preheated tool the solidified amorphous metal on the inner core could break. A reduced tool temperature is also advantageous for the rapid cooling of the melt to amorphous metal. A high tool temperature (as would be necessary with no separation element) would lead to slower cooling, which in turn could promote undesired crystallization of the metal. In addition, at lower tool temperatures there are fewer leaks and/or stresses in the tool.

Another aspect of the present invention relates to a hollow article made of amorphous metal, wherein the hollow space of the hollow article has a length in the range from 1 to 40 cm, preferably in the range from 2 to 30 cm, more preferably in the range from 4 to 20 cm, and most preferably in the range from 6 to 10 cm.

Further advantageous embodiment possibilities of the method according to the invention and of the hollow article of the invention made of amorphous metal are defined in the dependent claims.

THE METHOD

One aspect of the present invention relates to a method for producing a hollow article made of amorphous metal. The method comprises the steps of:

a) providing a metallic composition suitable for producing amorphous metal, b) melting the composition according to step a), in order to obtain a melt, c) introducing the melt after step b) into a cavity of a casting mold, wherein the mold comprises an inner core, wherein at least a part of the lateral surface of the inner core is enclosed by a separation element, and wherein the separation element is not attached to the inner core, d) cooling the melt in the casting mold, in order to obtain a molded part made of amorphous metal, e) removing the inner core and the separation element from the molded part after step d), in order to obtain a hollow article made of amorphous metal.

The method comprises a step a): providing a metallic composition suitable for producing amorphous metal.

Metallic compositions that are suitable for producing amorphous metals are sufficiently known to the person skilled in the art. Such metallic compositions are described, for example, in Chapter 1 of "Bulk Metallic Glass—An Overview", Springer, 2009.

The metallic composition according to step a) can be a composition of at least three elements, preferably of at least three metals. It is preferred that the at least three elements have a difference in atomic radius of more than 10%, preferably more than 12%. In a preferred embodiment, the at least three elements are selected from the group consisting of iron, palladium, platinum, tin, silicon, gallium, cobalt, zirconium, copper, aluminum, hafnium, nickel, niobium and titanium, more preferably consisting of zirconium, copper, aluminum, hafnium, nickel, niobium and titanium.

According to one embodiment of the present invention, the metallic composition according to step a) is a zirconium-based alloy that preferably comprises a plurality of elements selected from the group consisting of copper, aluminum, hafnium, nickel, niobium and titanium. A "zirconium-based alloy" is an alloy that has at least 40% by weight, preferably 60% by weight, zirconium.

In a particularly preferred embodiment, the metallic composition according to step a) comprises or consists of 58 to 77% by weight zirconium, 0 to 3% by weight hafnium, 20 to 30% by weight copper, 2 to 6% by weight aluminum, and 1 to 3% by weight niobium.

In another particularly preferred embodiment, the metallic composition according to step a) comprises or consists of 54 to 76% by weight zirconium, 2 to 5% by weight titanium, 12 to 20% by weight copper, 2 to 6% by weight aluminum, and 8 to 15 by weight nickel.

It is preferred here that the sum of the chemical elements is 100%. The remainder is then zirconium. Typical impurities may be present in the alloy.

According to another embodiment of the present invention, the metallic composition according to step a) is a copper-based alloy that preferably comprises a plurality of elements selected from the group consisting of zirconium, nickel, tin, silicon and titanium. A "copper-based alloy" is an alloy that has at least 40% by weight, preferably 60% by weight, copper. Suitable copper-based alloys are described, for example, in EP 3444370 A1.

According to one embodiment of the present invention, the metallic composition according to step a) has a difference between the crystallization temperature Tx and the glass transition temperature Tg of at least 30° C., preferably of at least 40° C., more preferably of at least 50° C., and most preferably in the range from 50 to 80° C. According to a further embodiment of the present invention, the metallic composition according to step a) has a difference between the crystallization temperature Tx and the glass transition temperature Tg in the range from 30 to 150° C., preferably in the range from 40 to 120° C., and most preferably in the range from 50 to 80° C.

The composition according to step a) can further have a liquidus temperature TL in the range from 700 to 1200° C., preferably in the range from 750 to 1000° C. The solidus temperature of the composition according to step a) can be in the range from 600 to 1000° C., preferably in the range from 700 to 950° C.

The method also comprises a step b): Melting the composition according to step a), in order to obtain a melt.

Step b) is not limited to a specific melting device, heat source or melting parameter. Instead, the person skilled in the art will select a suitable device and heat source along with the parameters of the melting process according to his needs and with regard to the metallic composition used according to step a).

The melt can be produced, for example, in step b) in which the composition according to step a) is heated or melted by high-frequency induction heating, arc discharge, electron beam irradiation, laser beam irradiation or infrared irradiation. High-frequency induction heating in step b) is preferably applied.

In step b), work preferably takes place in a protective gas atmosphere, in order to prevent oxidation of the metallic melt by oxygen. The protective gas atmosphere can be maintained until the melt is cooled in step d). A suitable protective gas is, for example, argon. Before the protective gas is introduced, the atmosphere can be evacuated.

Method according to the invention further comprises a step c): introducing the melt into a cavity of a casting mold after step b), wherein the mold comprises an inner core, wherein at least a part of the lateral surface of the inner core is enclosed by a separation element, and wherein the separation element is not attached to the inner core.

The inner core has a lateral surface. The "lateral surface" is the entire surface of the shaping part of the core excluding the base surface of the core. The "shaping part" of the inner core refers to the part of the core that is used to form the cavity of the hollow article. The shaping part of the core does not include the part or partial area of the core that, for example, is merely fitted into the tool or directly adjoins it, without thereby achieving a shaping function.

The inner core can in principle have any shape suitable for the design of a tool inner core. The inner core can have the shape of a cylinder, a triangular prism, a cuboid, a disk or a stepped pyramid structure. The inner core preferably has the shape of a cylinder or a cuboid, In a preferred embodiment of the present invention, the inner core is a cylindrical inner core. The cylindrical inner core can have the shape of an elliptical cylinder, a circular cylinder or an angular cylinder. It is preferred that the inner core has the shape of a circular cylinder. In a particularly preferred embodiment, the cylindrical inner core is a straight circular cylindrical inner core.

The arrangement of the inner core in the casting mold in step c) can be adapted to the desired shape of the cast hollow article. The inner core can be arranged such that a hole, an inner contour or a penetration of the molded part are formed.

Furthermore, the inner core can have a demolding draft. Demolding drafts are known to the person skilled in the art. A demolding draft is a slope that is added to a surface that is arranged parallel to the demolding direction of the molded part. A demolding draft is added to a molded part, in order to facilitate demolding. Depending on the shape of the molded part, a demolding draft can have an angle in the range of 0.1 to 10°. In one embodiment of the present invention, the inner core has a demolding draft of less than 0.2°.

However, it is not necessary for the inner core to have a demolding draft. This is one of the advantages of the present invention. In a particularly preferred embodiment of the present invention, the inner core has no demolding draft, in particular at a room temperature of 20° C. In a preferred embodiment of the present invention, the inner core has a constant diameter. In a preferred embodiment of the present invention, the cylindrical inner core has no demolding draft. In a preferred embodiment of the present invention, the cylindrical inner core has a constant diameter.

The inner core can have a diameter in the range from 5 to 100 mm, preferably in the range from 5 to 50 mm, more preferably in the range from 5 to 25 mm, and/or have a length in the range from 1 to 40 cm, preferably in the range from 2 to 20 cm, more preferably in the range from 4 to 15 cm, and most preferably in the range from 6 to 10 cm. The aforementioned dimensions are measured at a temperature of 20° C.

The dimensions defined here, such as length and diameter of the inner core, always refer to the shaping part of the inner core.

The inner core can also have two or more different diameters in a stepped form. Undercuts in the outer diameter of the inner core are also possible. For such a case, the person skilled in the art can adjust the tool accordingly.

The inner core can preferably have a constant diameter in the range from 5 to 100 mm, preferably in the range from 5 to 50 mm, more preferably in the range from 5 to 25 mm, and/or the core can have a length in the range from 1 to 40 cm, preferably in the range from 2 to 20 cm, more preferably in the range from 4 to 15 cm, and most preferably in the range from 6 to 10 cm. The inner core can particularly preferably have a length in the range from 1 to 40 cm, preferably in the range from 2 to 20 cm, more preferably in the range from 4 to 15 cm, and most preferably in the range from 6 to 10 cm.

The cylindrical inner core can particularly preferably have a constant diameter in the range from 5 to 100 mm, preferably in the range from 5 to 50 mm, more preferably in the range from 5 to 25 mm, and/or the core can have a length in the range from 1 to 40 cm, preferably in the range from 2 to 20 cm, and more preferably in the range from 4 to 15 cm, and most preferably in the range from 6 to 10 cm. The cylindrical inner core is preferably a circular cylindrical inner core, wherein the circular cylinder has a constant diameter in the range from 5 to 100 mm, preferably in the range from 5 to 50 mm, more preferably in the range from 5 to 25 mm, and/or wherein the core has a length in the range from 1 to 40 cm, preferably in the range from 2 to 20 cm, and more preferably in the range from 4 to 15 cm, and most preferably in the range from 6 to 10 cm.

The inner core can be made of any material suitable for use in a metal casting mold. For example, the inner core can be steel.

The inner core can be part of a split. Splits are known to the person skilled in the art.

The shape of the separation element is adapted to the shape of the inner core such that at least a part of the lateral surface of the inner core is enclosed. If the inner core is designed, for example, in the form of a circular cylinder, the separation element can be designed in the form of a hollow cylinder. If the inner core is designed in the form of an angular cylinder, the separation element can be designed in the form of a polygonal cylinder, etc. In a preferred embodiment, the separation element is adapted in its shape to the shape of the cylindrical inner core. In a particularly preferred embodiment, the separation element has the shape of a straight hollow cylinder.

Particularly preferably, the separation element has the shape of a sleeve. The separation element is very particularly preferably a copper sleeve.

The separation element can have a wall thickness in the range from 0.5 to 5 mm, preferably in the range from 1 to 3 mm, and/or have a length in the range from 1 to 40 cm, preferably in the range from 2 to 20 cm, more preferably in the range from 4 to 15 cm, and most preferably in the range from 6 to 10 cm. The separation element can have the shape of a straight hollow cylinder, wherein the hollow cylinder has a wall thickness in the range from 0.5 to 5 mm, preferably in the range from 1 to 3 mm, and/or wherein the hollow cylinder has a length in the range from 1 to 40 cm, preferably in the range from 2 to 20 cm, more preferably in the range from 4 to 15 cm, and most preferably in the range from 6 to 10 cm.

In a preferred embodiment of the invention, the aspect ratio (length/outer diameter) of the separation element has a value of 4 or more, in particular of 5 or more and very particularly preferably of 7 or more. The dimensions of the inner core are preferably adapted accordingly.

The inner diameter of the separation element is preferably adapted to the diameter of the inner core. All dimensions of the inner core and the separation element refer to dimensions at a room temperature of 20° C.

The separation element can have a demolding draft. In one embodiment of the present invention, the inner core has a demolding draft of less than 0.2°.

However, such a design of the separation element is not necessary. This is one of the advantages of the present invention. In a particularly preferred embodiment, the separation element has no demolding draft, in particular at a room temperature of 20° C. In a preferred embodiment, the separation element has a constant outer diameter. In a particularly preferred embodiment, neither the separation element nor the inner core has a demolding draft.

In step c), the separation element encloses at least a portion of the lateral surface of the inner core. In a preferred embodiment, the separation element in step c) surrounds the entire lateral surface of the inner core. If, for example, a cylindrical inner core can be used, a separation element can be used that surrounds the entire cylindrical lateral surface of the inner core. It is also possible for the separation element to surround the entire shaping part of the inner core.

In a further preferred embodiment, the separation element is so designed and so arranged on the lateral surface of the inner core that the melt in step c) does not come into contact with the lateral surface of the inner core. It is also possible for the separation element to be designed and arranged on the inner core such that the melt in step c) does not come into contact with the inner core.

The material of the separation element is not limited to a specific material.

The separation element can comprise or consist of a non-metallic material. For example, the separation element can comprise or consist of graphite.

The separation element can comprise or consist of a metal or an alloy. In a preferred embodiment of the present invention, the separation element comprises, preferably consists of, a metal or an alloy. Preferred metals or alloys are selected from the group consisting of copper, copper alloys, aluminum, aluminum alloys, unalloyed and low-alloy steel, zinc and zinc alloys. Particularly preferably, the separation element comprises or consists of copper or a copper alloy. The person skilled in the art is familiar with the terms "unalloyed" and "low-alloyed steel." A low-alloyed steel can be, for example, a steel in which the sum of the alloy elements does not exceed 6.0% by weight.

The material of the separation element can have a certain thermal conductivity. A material with a high thermal conductivity is particularly suitable for facilitating the rapid cooling of the melt to below the glass transition temperature Tg. The separation element preferably comprises or consists of a material that has a thermal conductivity K greater than 100 W/mK, preferably greater than 200 W/mK, and more preferably within the range of 200 to 450 W/mK.

The material of the separation element can also have a certain coefficient of thermal expansion. Preferably, the separation element comprises or consists of a material that has a coefficient of thermal linear expansion a (at 20° C.) greater than $10*10^{-6}$/K, preferably greater than $15*10^{-6}$/K, and more preferably in the range of $15*10^{-6}$/K to $40*10^{-6}$/K.

The material of the separation element can have a coefficient of thermal linear expansion a (at 20° C.) less than or equal to the coefficient of thermal linear expansion of the inner core. The material of the separation element can have a coefficient of thermal linear expansion a (at 20° C.) different from that of the material of the inner core. The separation element and the inner core can form a thermal mismatch or thermal misfit that facilitates demolding.

The inventors have found that the different coefficients of thermal expansion can lead to a lower tension between the separation and the inner core once the tool components have cooled down. In other words, the cast hollow article, including the sleeve, can shrink away from the inner core as a result of the cooling. The demolding of the hollow article from the casting mold is thus further facilitated, since even less force is necessary to remove the inner core from the recess of the hollow article.

In a preferred embodiment of the present invention, the method comprises, before steps b) or c), a step in which the separation element is pushed onto the inner core. The inner core with the attached separation element can then be arranged in the casting mold. In a preferred embodiment, in this step a hollow cylindrical separation element is pushed onto a cylindrical inner core.

The cavity of the casting mold in step c) determines the shape of the cast hollow article. The cavity can have a shape that is suitable for pouring a hollow article with a hollow space, wherein the hollow space is a hole, an inner contour or a penetration. The cavity preferably has a shape that is suitable for casting a tube.

The person skilled in the art will design the shape and dimensions of the cavity by selecting the inner core, the separation element and the casting mold such that a hollow article made of amorphous metal with a desired shape can be obtained.

The cavity of the casting mold preferably has a hollow cylindrical shape. The cavity preferably has the shape of a tube. In a preferred embodiment, the cavity of the casting mold in step c) is hollow-cylindrical and has a length in the range from 1 to 40 cm, preferably in the range from 2 to 20 cm, more preferably in the range from 4 to 15 cm, and at the preferred range from 6 to 10 cm, and/or wherein the cavity of the casting mold in step c) is hollow-cylindrical and has a width in the range from 0.5 to 20 mm, preferably in the range from 0.5 to 10 mm, and more preferably in the range from 0.5 to 5 mm. The "width" of the cavity relates to the hollow space that is to be filled and not to the overall width of the hollow cylinder.

The casting mold can also have a plurality of cavities, as are described here, in order to cast several hollow articles in one step.

Before the melt is introduced into the casting mold in step c), the casting mold, the inner core and/or the separation element can be preheated to a specific temperature in step c). According to a preferred embodiment, the casting mold, the inner core and/or the separation element, before the melt is introduced in step c), has a temperature in the range from 20 to 300° C., preferably in the range from 20 to 200° C., and the most preferably in the range from 50 to 140° C.

FIG. 1 shows, by way of example, the cross-section of a cylindrical inner core (3) whose entire shaping lateral surface is enclosed by a hollow cylindrical separation element (2), wherein the separation element is surrounded by the cooled amorphous metal (1). Preferably, the inner core is made of steel, the separation element is made of copper and the amorphous metal is a tube based on a zirconium or copper alloy.

Method according to the invention comprises a step d): cooling the melt in the casting mold, in order to obtain a molded part made of amorphous metal.

The casting mold has a significantly lower temperature than the melt. For this reason, the melt can be introduced into the cavity of the casting mold for the cooling of the melt to form an amorphous metal.

However, it is also possible to actively cool the casting mold by means of a cooling system after the melt has been introduced. The cooling system can use a coolant such as water or a liquefied gas. Cooling systems for cooling a casting mold are known to the person skilled in the art.

The method according to the invention comprises a step e): removing the inner core and the separation element from the molded part after step d), in order to obtain a hollow article made of amorphous metal.

In step e), the inner core can be removed from the molded part after step d) by pulling the inner core out of the molded part or pressing it out of the molded part. The inner core is preferably pressed out of the molded part. The cylindrical inner core is preferably pressed out of the molded part. After removal of the molded part from the mold or before removal from the mold, the core can be removed.

After the inner core has been removed, the separation element remains on the inside of the hollow article. The separation element can then be removed mechanically. For example, the separation element can be rotated out of the hollow space of the hollow article.

To facilitate removal of the separation element, the separation element can be chemically treated, for example by an etching step. Chemical treatment by etching can be carried out, for example, in the case of a separation element that comprises or consists of copper or a copper alloy. It is also possible to cut into the separation element before removal in order to reduce the tension between the separation element and the hollow article.

According to a preferred embodiment, step e) comprises the steps of e1) removing the inner core from the molded part after step d), in order to obtain a hollow article made of amorphous metal, which has the separation element on its inner side, e2) removing the separation element from the inside of the hollow article.

According to a preferred embodiment, step e) comprises the steps of e1) removing the inner core from the molded part after step d) before or after the molded part has been removed from the casting mold, in order to obtain a hollow article made of amorphous metal, which has the separation element on its inner side, e2) removing the separation element from the inside of the hollow article.

According to a preferred embodiment, the method according to the invention is a metal injection-molding method. According to a preferred embodiment, the method according to the invention is a metal injection-molding method for producing amorphous metals. Metal injection-molding processes are known in principle. Metal injection-molding methods for producing amorphous metals have known differences to conventional metal injection-molding methods. For example, no binder is used in the metal injection-molding process and the step of debinding is also omitted.

The method can be, for example, a metal injection-molding method for the production of amorphous metals, which is carried out by means of an Engel Victory 120 amorphous metal molding machine from the Engel company.

According to a further preferred embodiment, the method according to the invention is a metal injection-molding method, wherein in step b) the metallic composition according to step a) is melted in a melting hearth and the melt is subsequently transferred into an injection chamber, and wherein in step c) the melt is injected under pressure into the cavity of the casting mold via a channel from the injection chamber, so that the cavity is completely filled.

In addition, the method according to the invention can comprise further method steps known in the prior art, such as, for example, a step for the heat treatment of the hollow article and/or a step for the cleaning of the hollow article.

The method according to the invention is preferably designed such that a tube is produced. It is known to the person skilled in the art which shapes of the inner core, the casting mold and the cavity are necessary for this purpose.

Further Preferred Embodiments

According to a particularly preferred embodiment, the method according to the invention for producing a hollow article made of amorphous metal comprises the steps of:

a) providing a metallic composition suitable for producing amorphous metal, b) melting the composition according to step a), in order to obtain a melt, c) introducing the melt after step b) into a cavity of a casting mold, wherein the mold comprises an inner core, wherein the inner core has a length in the range from 1 to 40 cm, preferably in the range from 2 to 20 cm, more preferably in the range from 4 to 15 cm, and most preferably in the range from 6 to 10 cm, wherein the entire lateral surface of the inner core is enclosed by a separation element, wherein the separation element is not attached to the inner core, and wherein neither the separation element nor the inner core has a demolding draft, d) cooling the melt in the casting mold, in order to obtain a molded part made of amorphous metal, e) removing the inner core and the separation element from the molded part after step d), in order to obtain a hollow article made of amorphous metal.

According to a particularly preferred embodiment, the method according to the invention for producing a hollow article made of amorphous metal comprises the steps of:

a) providing a metallic composition suitable for producing amorphous metal, b) melting the composition according to step a), in order to obtain a melt, c) introducing the melt after step b) into a cavity of a casting mold, wherein the mold comprises an inner core, wherein the shaping part of the inner core has a length in the range from 1 to 40 cm, preferably in the range from 2 to 20 cm, more preferably in the range from 4 to 15 cm, and most preferably in the range from 6 to 10 cm, wherein the entire lateral surface of the shaping part of the cylindrical inner core is enclosed by a separation element, wherein the separation element is not attached to the inner core, wherein the separation element consists of copper or a copper alloy, and wherein neither the separation element nor the inner core has a demolding draft, d) cooling the melt in the casting mold, in order to obtain a molded part made of amorphous metal, e) removing the inner core and the separation element from the molded part after step d), in order to obtain a hollow article made of amorphous metal.

According to a particularly preferred embodiment, the method according to the invention is a metal injection-molding method for producing a hollow article made of amorphous metal, which comprises the steps of:

a) providing a metallic composition suitable for producing amorphous metal, b) melting the composition according to step a), in order to obtain a melt, c) introducing the melt after step b) into a cavity of a casting mold, wherein the mold comprises an inner core, wherein the entire lateral surface of the inner core is enclosed by a separation element, wherein the separation element is made of copper or a copper alloy, and wherein the separation element is not attached to the inner core, d) cooling the melt in the casting mold, in order to obtain a molded part made of amorphous metal, e) removing the inner core and the separation element from the molded part after step d), in order to obtain a hollow article made of amorphous metal.

According to a particularly preferred embodiment, the method according to the invention is a metal injection-molding method for producing a hollow article made of amorphous metal, which comprises the steps of:

a) providing a metallic composition suitable for producing amorphous metal, b) melting the composition according to step a), in order to obtain a melt, c) introducing the melt after step b) into a cavity of a casting mold, wherein the mold comprises a cylindrical inner core, wherein the entire lateral surface of the cylindrical inner core is enclosed by a separation element, wherein the separation element is made of copper or a copper alloy, and wherein the separation element is not attached to the cylindrical inner core, d) cooling the melt in the casting mold, in order to obtain a molded part made of amorphous metal, e) removing the cylindrical inner core and the separation member from the molded part after step d), in order to obtain a hollow article made of amorphous metal.

According to a particularly preferred embodiment, the method according to the invention is a metal injection-molding method for producing a tube made of amorphous metal, which comprises the steps of:

a) providing a metallic composition suitable for producing amorphous metal, b) melting the composition according to step a), in order to obtain a melt, c) introducing the melt after step b) into a cavity of a casting mold, wherein the mold comprises a cylindrical inner core, wherein the cylindrical inner core is made of steel, wherein the entire lateral surface of the cylindrical inner core is enclosed by a separation element, wherein the separation element is made of copper or a copper alloy, and wherein the separation element is not attached to the cylindrical inner core, d) cooling the melt in the casting mold, in order to obtain a molded part made of amorphous metal, e1) removing the inner core from the mold piece after step d) before or after the mold piece has been removed from the casting mold, in order to obtain a tube made of amorphous metal that has the separation element on its inner side, e2) removing the separation element from the inside of the tube.

According to a particularly preferred embodiment, the method according to the invention is a metal injection-molding method for producing a hollow article made of amorphous metal, which comprises the steps of:

a) providing a metallic composition suitable for producing amorphous metal, b) melting the composition according to step a), in order to obtain a melt, c) introducing the melt after step b) into a cavity of a casting mold, wherein the mold comprises a cylindrical inner core, wherein at least a portion of the lateral surface of the cylindrical inner core is enclosed by a separation element, so that the melt cannot come into contact with the lateral surface of the inner core, wherein the separation element is made of copper or a copper alloy, and wherein the separation element is not attached to the cylindrical inner core, d) cooling the melt in the casting mold, in order to obtain a molded part made of amorphous metal, e) removing the cylindrical inner core and the separation member from the molded part after step d), in order to obtain a hollow article made of amorphous metal.

According to a particularly preferred embodiment, the method according to the invention is a metal injection-molding method for producing a tube made of amorphous metal, which comprises the steps of:

a) providing a metallic composition suitable for producing amorphous metal, b) melting the composition according to step a), in order to obtain a melt, c) introducing the melt after step b) into a cavity of a casting mold, wherein the mold comprises a cylindrical inner core, wherein the cylindrical inner core is made of steel, wherein at least a portion of the lateral surface of the cylindrical inner core is enclosed by a separation element, so that the melt cannot come into contact with the lateral surface of the inner core, wherein the separation element is made of copper or a copper alloy, and wherein the separation element is not attached to the cylindrical inner core, d) cooling the melt in the casting mold, in order to obtain a molded part made of amorphous metal, e1) removing the inner core from the mold piece after step d) before or after the mold piece has been removed from the casting mold, in order to obtain a tube made of amorphous metal that has the separation element on its inner side, e2) removing the separation element from the inside of the tube.

The Hollow Article Made of Amorphous Metal

Another aspect of the present invention relates to a hollow article made of amorphous metal, wherein the hollow space of the hollow article has a length in the range from 1 to 40 cm. A further aspect of the present invention relates to a hollow article made of amorphous metal obtainable by the method according to the invention. In addition, an aspect of the present invention relates to a hollow article made of amorphous metal obtained by the method according to the invention.

The inventors have surprisingly found that, due to the simple demolding and/or the improved process parameters, the method according to the invention makes accessible a hollow article made of amorphous metal with improved quality, in particular with improved quality of the inner surface of the hollow article. In addition, the inventors have found that the method according to the invention makes it possible to obtain hollow articles made of amorphous metal whose shape was not previously possible.

The hollow space of the hollow article preferably has a length in the range from 2 to 20 cm or 4 to 20 cm, more preferably in the range from 4 to 15 cm, and most preferably in the range from 6 to 10 cm.

The hollow space of the hollow article preferably has no demolding draft. The hollow space of the hollow article preferably has a length in the range from 2 to 20 cm or 4 to 20 cm, more preferably in the range from 4 to 15 cm, and most preferably in the range from 6 to 10 cm, wherein the hollow space has no demolding draft. The hollow space can have, for example, a length of 6 to 10 cm and no demolding draft.

The hollow space of the hollow article can have an inner diameter in the range from 5 to 100 mm, preferably in the range from 5 to 50 mm, more preferably in the range from 5 to 25 mm, and most preferably in the range from 5 to 20 mm. It is also possible for the hollow space to have two or more different inner diameters in stepped form.

However, it is preferred that the hollow space of the hollow article has a constant inner diameter. Particularly preferably, the hollow space has a cylindrical shape. Even more preferably, the hollow space of the hollow article has a cylindrical shape, wherein the hollow space has a constant inner diameter.

The hollow space of the hollow article can be a hole, an inner contour or a penetration.

The hollow article is not limited to a specific shape. In particular, the hollow article is not limited with respect to its external shape. The external shape, as also the cavity of the mold, can be designed according to the wishes and needs of the person skilled in the art.

In a preferred embodiment, the hollow article is a hollow cylinder, preferably a hollow circular cylinder. In a further preferred embodiment, the hollow article is a tube. The hollow space of the tube preferably has no demolding draft.

The hollow article is preferably a tube, wherein the tube has a length in the range from 1 to 40 cm or 4 to 40 cm, preferably in the range from 2 to 20 cm, more preferably in the range from 4 to 15 cm, and most preferably in the range from 6 to 10 cm, and/or wherein the tube has a wall thickness in the range from 0.5 to 20 mm, preferably in the range from 0.5 to 10 mm, more preferably in the range from 0.5 to 5 mm, and most preferably in the range from 0.5 to 3 mm, and/or wherein the tube has a constant inner diameter in the range from 5 to 100 mm, preferably in the range from 5 to 50 mm, more preferably in the range from 5 to 25 mm, and most preferably in the range from 5 to 20 mm.

The hollow article is preferably a tube, wherein the tube has a length in the range from 1 to 40 cm, preferably in the range from 2 to 20 cm, more preferably in the range from 4 to 15 cm, and most preferably in the range from 6 to 10 cm, and wherein the tube has a constant inner diameter in the range from 5 to 100 mm, preferably in the range from 5 to 50 mm, more preferably in the range from 5 to 25 mm, and most preferably in the range from 5 to 20 mm.

The tube can have, for example, a length of 6 to 10 cm and a constant internal diameter of 5 to 20 mm.

The hollow article is preferably a tube, wherein the tube has a length in the range from 1 to 40 cm, preferably in the range from 2 to 20 cm, more preferably in the range from 4 to 15 cm, and most preferably in the range from 6 to 10 cm, and wherein the tube has a wall thickness in the range from 0.5 to 20 mm, preferably in the range from 0.5 to 10 mm, more preferably in the range from 0.5 to 5 mm, and most preferably in the range from 0.5 to 3 mm, and wherein the tube has a constant inner diameter in the range from 5 to 100 mm, preferably in the range from 5 to 50 mm, more preferably in the range from 5 to 25 mm, and most preferably in the range from 5 to 20 mm.

The tube can have, for example, a length in the range from 6 to 10 cm, a wall thickness in the range from 0.5 to 3 mm, and a constant inner diameter in the range from 5 to 20 mm.

The hollow article can comprise a metallic composition of at least three metals. It is preferred that the at least three metals have a difference in atomic radius of more than 10%, preferably more than 12%. In a preferred embodiment, the at least three metals are selected from the group consisting of iron, palladium, platinum, tin, silicon, gallium, cobalt, zirconium, copper, aluminum, hafnium, nickel, niobium and titanium, more preferably consisting of zirconium, copper, aluminum, hafnium, nickel, niobium and titanium.

According to one embodiment of the present invention, the hollow article comprises or consists of a zirconium-based alloy, which preferably comprises a plurality of elements selected from the group consisting of copper, aluminum, hafnium, nickel, niobium and titanium.

According to one embodiment, the hollow article comprises or consists of a copper-based alloy, which preferably comprises a plurality of elements selected from the group consisting of zirconium, nickel, tin, silicon and titanium.

In a particularly preferred embodiment, the hollow article comprises or consists of 58 to 77% by weight zirconium, 0 to 3% by weight hafnium, 20 to 30% by weight copper, 2 to 6% by weight aluminum, and 1 to 3% by weight niobium. In another particularly preferred embodiment, the hollow article comprises or consists of 54 to 76% by weight zirconium, 2 to 5% by weight titanium, 12 to 20% by weight copper, 2 to 6% by weight aluminum, and 8 to 15% by weight nickel. It is preferred here that the sum of the chemical elements is 100%. The remainder is then zirconium. Typical impurities may be present in the alloy.

The hollow article is preferably a tube, wherein the tube has a length in the range from 1 to 40 cm, preferably in the range from 2 to 20 cm, more preferably in the range from 4 to 15 cm, and most preferably in the range from 6 to 10 cm, and wherein the tube has a constant inner diameter in the range from 5 to 100 mm, preferably in the range from 5 to 50 mm, more preferably in the range from 5 to 25 mm, and most preferably in the range from 5 to 20 mm, and wherein the tube consists of a zirconium-based alloys or of a copper-based alloy.

Exemplary Embodiment (1) Material

Separation element:

Sleeve, copper, external diameter 15 mm, wall thickness 1 mm

Metallic composition for producing the amorphous metal:

Alloy VIT105 $Zr_{52.5}Ti_5Cu_{17.9}Ni_{14.6}Al_{10}$

Tool:

Tool comprises two halves that can be opened; inner core can be removed; tool material (incl. core): steel alloy Machine for injection-molding the amorphous metal:

Engel VC120 AMM (2) Method

The method was carried out as follows:

a) Inner core was sprayed with demolding agent (graphite);
b) Copper sleeve was pushed over the inner core; the sleeve had about 0.2 mm play;
c) Inner core with copper sleeve was arranged in the tool;
d) Tool was preheated to a temperature in the range of 50 to 140° C.;
e) Closed tool was evacuated to a pressure in the range from 0.1 to 0.05 mBar;
f) Pre-alloy was heated with an induction coil for about 20 s to about 1100° C.;
g) Melt was injected into the cavity;
h) Tool was cooled (active tool cooling, approx. 5 s)
i) Workpiece incl. inner core was removed (at about 80° C. temp. of the workpiece)
j) Steel core was removed by pressing out, the copper sleeve was only slotted with a Dremel and then removed.

Figure 2:
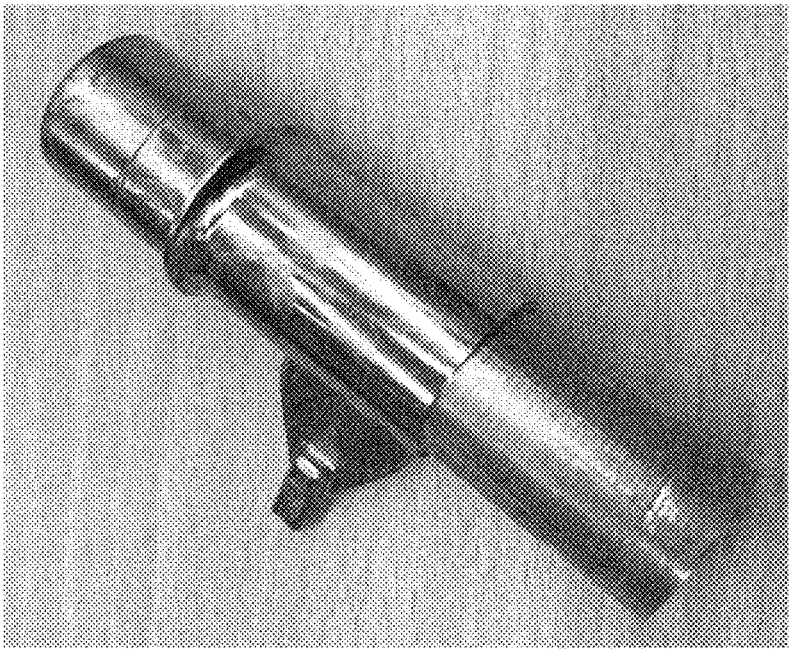
FIG. 2 shows a portion of a tube made of amorphous metal with a copper sleeve in the hollow space of the tube.

FIG. 2 shows a portion of a tube made of amorphous metal with a copper sleeve in the hollow space of the tube.

Figure 3:
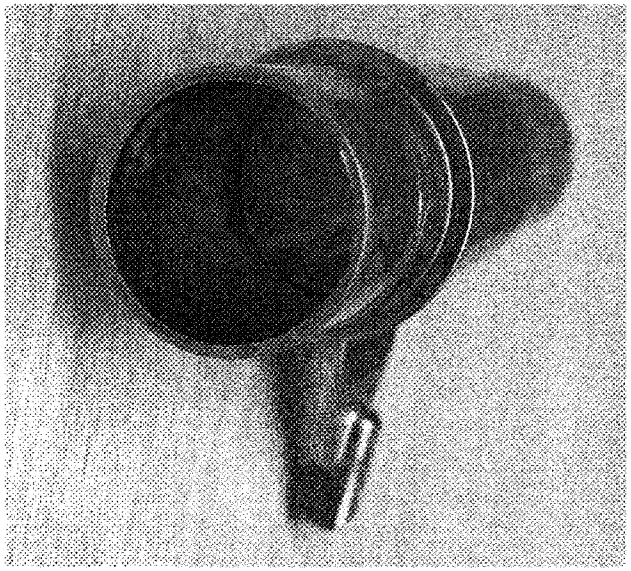
FIG. 3 shows a part of a tube made of amorphous metal with a slotted and partially pressed-out copper sleeve.

FIG. 3 shows a part of a tube made of amorphous metal with a slotted and partially pressed-out copper sleeve.

A comparative test was carried out with an inner core made of steel without the use of a copper sleeve. Here, the steel core was directly overmolded with the melt at a tool temperature of about 200° C. The cast tube had cracks and the core could only be removed due to the damage to the tube.

The invention claimed is:

1. A method for producing a hollow article made of amorphous metal, the method comprising the steps of:

a) providing a metallic composition suitable for producing amorphous metal,
b) melting the composition according to step a), in order to obtain a melt,
c) introducing the melt after step b) into a cavity of a casting mold,
wherein the mold comprises an inner core,
wherein at least a part of a lateral surface of the inner core is enclosed by a separation element, and
wherein the separation element is not attached to the inner core,
d) cooling the melt in the casting mold, in order to obtain a molded part made of the amorphous metal, e) removing the inner core and the separation element from the molded part after step d), in order to obtain a hollow article made of amorphous metal.

2. The method according to claim 1, wherein the separation element comprises a metal or an alloy.

3. The method according to claim 2, wherein the metal or the alloy is selected from the group consisting of copper, copper alloys, aluminum, aluminum alloys, unalloyed and low-alloyed steel, zinc and zinc alloys.

4. The method according to claim 1, wherein the method before step b) or c) comprises a step in which the separation element is pushed onto the inner core.

5. The method according to claim 1, wherein the separation element in step c) encloses the entire lateral surface of the inner core.

6. The method according to claim 1, wherein the inner core and/or the separation element do not have a demolding draft.

7. The method according to claim 1, wherein the step e) comprises the steps of:

e1) removing the inner core from the molded part after step d), in order to obtain a hollow article made of amorphous metal that has the separation element on its inner side, e2) removing the separation element from the inside of the hollow article.

8. The method according to claim 1, wherein the inner core has a diameter in a range from 5 to 100 mm, and/or wherein the inner core has a length in a range from 1 to 40 cm.

9. The method according to claim 1, wherein the inner core is a cylindrical inner core, and the separation element is a hollow cylindrical separation element.

10. The method according to claim 1, wherein the metallic composition according to step a) is a zirconium-based alloy that comprises a plurality of elements selected from the group consisting of copper, aluminum, hafnium, nickel, niobium and titanium, or wherein the metallic composition according to step a) is a copper-based alloy that preferably comprises a plurality of elements selected from the group consisting of zirconium, nickel, tin, silicon and titanium.

11. The method according to claim 1, wherein the method is a metal injection-molding method.

12. The method according to claim 1, wherein the casting mold, the inner core and/or the separation element before the melt is introduced in step c) have a temperature in the range from 20 to 300° C.

* * * * *